United States Patent [19]

Ericson

[11] 4,232,706

[45] Nov. 11, 1980

[54] AUTOMATIC VALVE DEVICE FOR SANITATION WASTE PIPES

[76] Inventor: Kurt S. B. Ericson, Goudenregenlaan, 17, B-2610 Wilrijk, Belgium

[21] Appl. No.: 938,337

[22] Filed: Aug. 31, 1978

[30] Foreign Application Priority Data

Aug. 31, 1977 [BE] Belgium ..... 858265

[51] Int. Cl.[3] ..... E03C 1/295

[52] U.S. Cl. ..... 137/375; 137/216.2; 137/357; 137/526; 137/533

[58] Field of Search ..... 137/216.2, 217, 218, 137/375, 247.35, 247.41, 247.43, 247.45, 247.47, 247.49, 247.51, 357, 362, 526, 533; 4/207, 211

[56] References Cited

U.S. PATENT DOCUMENTS

| | | | |
|---|---|---|---|
| 675,342 | 5/1901 | Sayers | 137/216.2 X |
| 793,989 | 7/1905 | Clark | 137/216.2 |
| 2,405,241 | 8/1946 | Smith | 137/526 |
| 2,940,464 | 6/1960 | Moen | 137/218 |
| 3,207,171 | 9/1965 | Kryman | 137/218 |
| 3,923,081 | 12/1975 | Persson | 137/217 |
| 4,071,043 | 1/1978 | Carlson | 137/375 |

*Primary Examiner*—Gerald A. Michalsky
*Attorney, Agent, or Firm*—McGlew and Tuttle

[57] ABSTRACT

The invention relates to an automatic air valve device for sanitation waste pipes for preventing communication in the rooms between the waste pipes and atmosphere and to permit the introduction of fresh air into the pipes when a negative pressure occurs.

It comprises a body formed by a vertical tube in communication with a waste pipe, the said body having at its upper part a constriction in the form of a Venturi cooperating with a cover so as to form a peripheral air inlet situated at the exterior of the constriction.

The said air inlet is provided with an annular valve.

Around the cover and the upper end of the cylindrical body there is an insulating covering in which there is formed a circular recess providing communication with the atmosphere (FIG. 1).

8 Claims, 8 Drawing Figures

FIG. 4
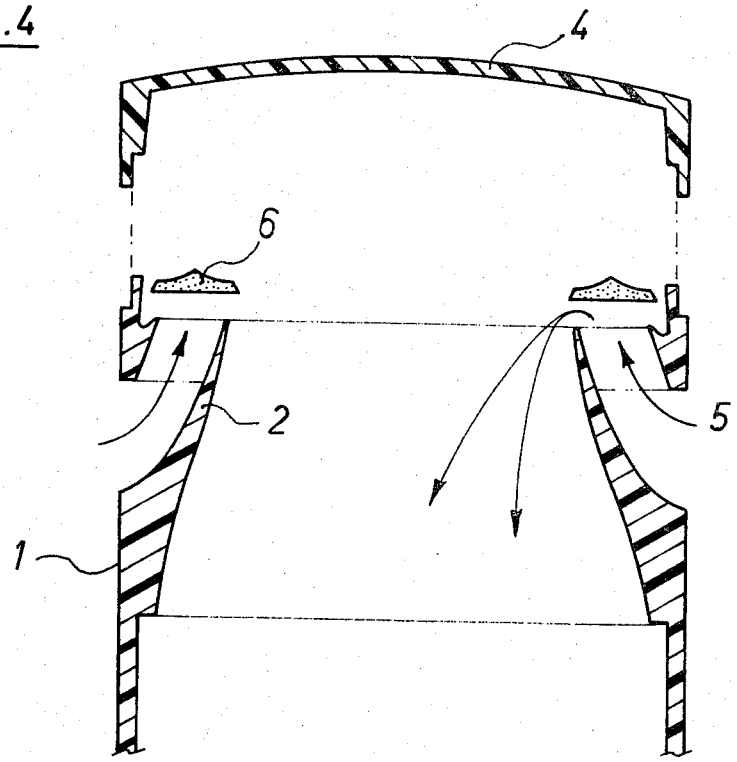
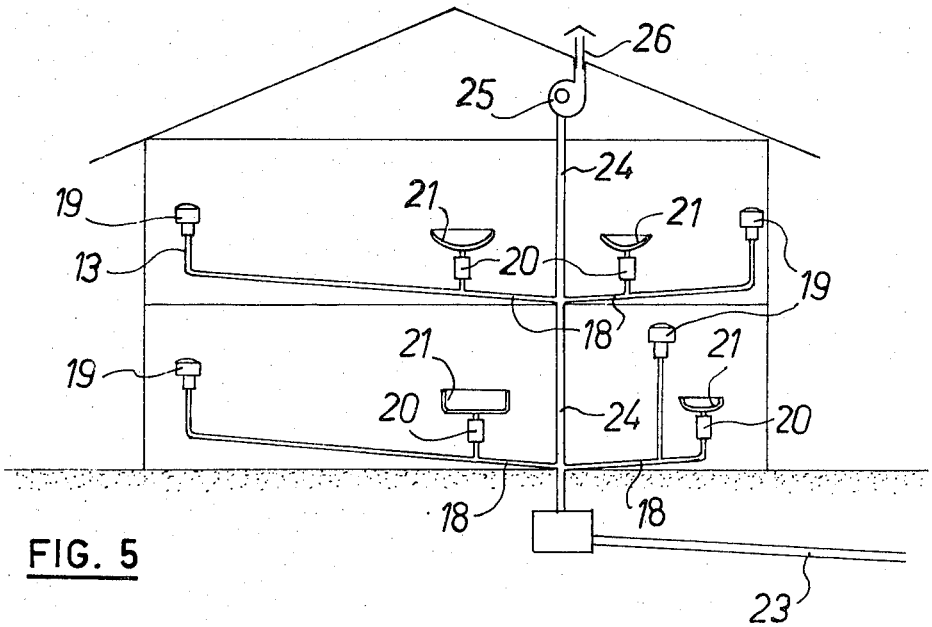
FIG. 5

AUTOMATIC VALVE DEVICE FOR SANITATION WASTE PIPES

BACKGROUND OF THE INVENTION

Automatic valve systems or devices are known (U.S. Pat. No. 3.923.081) for preventing communication between waste pipes atmosphere and which operate so that the discharge of contaminated air is prevented but which to allow air to enter the pipes when a negative pressure occurs therein.

These valves satisfy requirements according to which the pipes projecting from roofs may be dispensed with and be replaced by pipes housed inside buildings on condition that the general pipeline is provided with an automatic valve which does not allow stale air to escape but which allows air to enter in the event of a negative pressure, e.g. on the flushing of water closets.

SUMMARY OF THE INVENTION

The object of this invention is to produce devices of a simple design intended to solve various important problems associated with the use of such automatic valves.

These problems are as follows:

(a) The valve operation must be absolutely reliable and the valve capacity must be capable of being increased.

(b) The use of a single valve type must be possible for connecting vent pipes of different diameters.

(c) The valve must be protected thermally and against the risk of the entry of foreign bodies which might prevent correct operation.

The device according to the invention is characterised essentially in that a vertical tube constituting the body of the valve comprises at its upper end a constriction in the form of a Venturi which cooperates with a cover so as to form a peripheral air inlet provided with a valve situated at the exterior of the constriction and which can be tilted when a negative pressure occurs in the pipes while permitting the fresh air to penetrate into the vertical pipe and which when the pressure is equilibrated or when there is overpressure occupies a position of obturation in which the escape of contaminated air is prevented.

In accordance with an object of the invention, an automatic valve device connectable to a sanitation waste pipe is provided for preventing discharge of waste gas from the pipe to the atmosphere and for admitting atmospheric air into the waste pipe in response to a pressure reduction in the waste pipe. A valve device includes a tubular member having an upper conical section which tapers inwardly and upwardly so that the cross-section of the tubular member diminishes at its upper end. A cylindrical cover member overlies the upper end of the conical section and has a top wall spaced above the upper end of the conical section to form a valve seat chamber therebetween and an interior side wall having an inwardly extending portion spaced radially from at least part of the upper portion of said conical member to form an annular flow passage therebetween communicating with the valve seat chamber. The inwardly extending portion defines with the upper edge of the conical section a support seat within the valve seat chamber. A valve member is movably mounted in the seat chamber and has a face portion designed for reception on the support seat to close the annular flow passage. A valve member is movably operative within the chamber to close the annular flow passage when the waste gas pressure in the waste pipe equals or exceeds atmospheric pressure and to open the flow passage to admit atmospheric air to the waste pipe when the waste gas pressure in the waste pipe is less than atmospheric pressure.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the annexed drawings:

FIG. 4 is a section of a modified embodiment with respect to FIG. 1.

FIG. 5 shows an example of application of the valve according to the invention.

DESCRIPTION OF THE PREFERRED EMBODIMENTS

Figure 1:
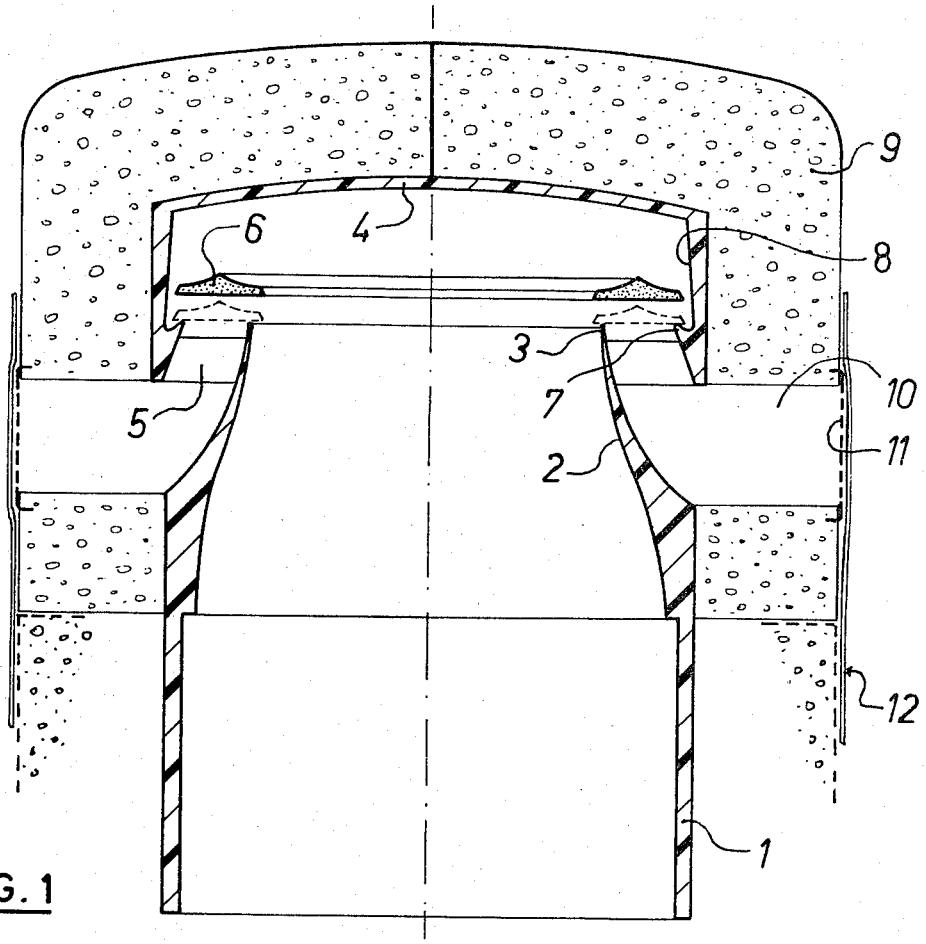
FIG. 1 is a section of a device in accordance with the invention.

Referring to FIG. 1, the valve body comprises a vertical tube 1 connected to a venting pipe (not shown in FIG. 1) such as may be provided for a sanitation waste pipe. At the top end of the tube 1, a constriction in the form of a Venturi is formed by a frusto-conical neck 2 terminating in a lip 3. The top end cooperates with a spaced cover 4 overlying the top end; so as to form a peripheral or annular air inlet 5 (flow passage) in the form of a duct which can be closed by an annular valve 6. In the example shown, the annular valve 6 is located at the exterior of the frusto-conical neck rests on a seat formed by the lip 3 and a lip 7 provided on the inner periphery of the cover.

It will be seen that if a negative pressure occurs in the vertical tube 1, for example, as a result of the draining, flushing or emptying operation, the valve 6 will be lifted from the seat formed by the lip 3 and the lip 7 so that fresh air can penetrate into the tube 1 via the duct 5. When the pressure is balanced or when there is an overpressure, in the venting pipe the duct 5 is shut off by the valve 6 sealing on the seat formed by the lip 3 and the lip 7 so that the contaminated air is prevented from leaving.

Figure 2:
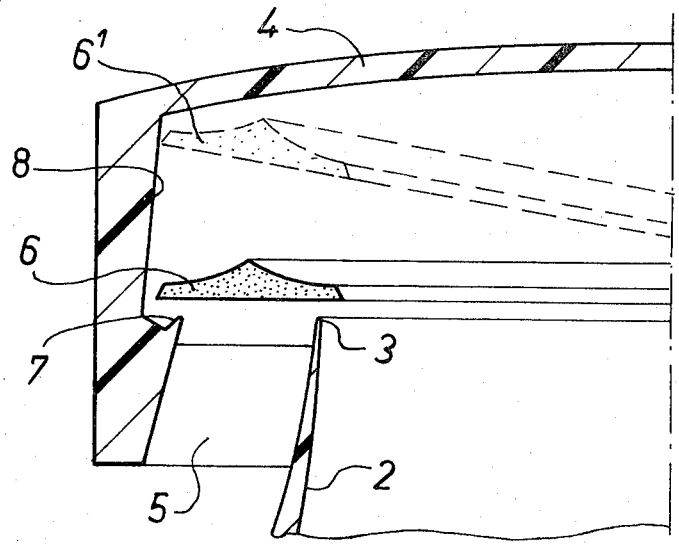
FIG. 2 is a detail in section to illustrate one of the advantages of the invention.

Because at the entry of the Venturi, at lip 3, the diameter is smaller than the diameter of the cylinder 1, an increase of the capacity of the valve is obtained which renders possible the use in buildings having a greater number of stores than with the known systems. One advantageous feature of an embodiment of the invention as illustrated by FIG. 2 is that an inner wall 8 of the cover 4 is inclined to an extent such that the valve 6 can never be jammed in an oblique or horizontal position in which the valve might stay in the open position $6^1$ when the pressure has been balanced.

Also, the dimensions are so selected that the valve 6 also covers the air inlet in its position of rest even if it touches the wall on one side.

As shown in FIG. 1, an insulation 9 is provided around the cover 4 including the inner wall 8 and the end of the cylindrical part of the body 1 and is formed with a circular recess 10 providing communication between the atmospheric or external air and the inlet duct 5.

The air inlet aperture 10 is conventionally provided with an element, e.g. a netting 11 so disposed and constructed as to prevent insects or foreign bodies from entering the aperture.

The insulation 9 enables the air to be kept hot inside the system and around the movable part 6 and prevents the valve from freezing.

Also, for transportation, the insulation 9 may be completed by a removable part (not shown) covering the entire bottom part of the cylinder 1.

A tape 12 may be wound around both insulating elements in order to lock such a packing which is obtained on transport and maintain proper operation during that period.

This tape is removed on use.

FIG. 4 relates to an embodiment which is particularly suitable for practicing the invention.

In this instance the cover 4 constitutes an element which is completely separated and is adapted to fit on the cylinder.

Figure 3:
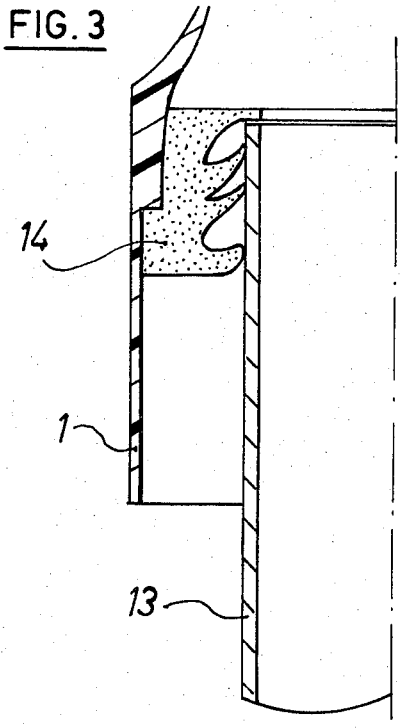
FIGS. 3, 3*a*, 3*b*, and 3*c* show the possibility of using a single type of automatic valve for pipes of different diameters.
Figure 3A:
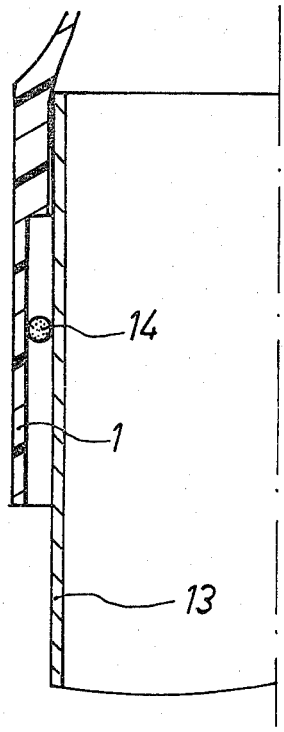
Figure 3B:
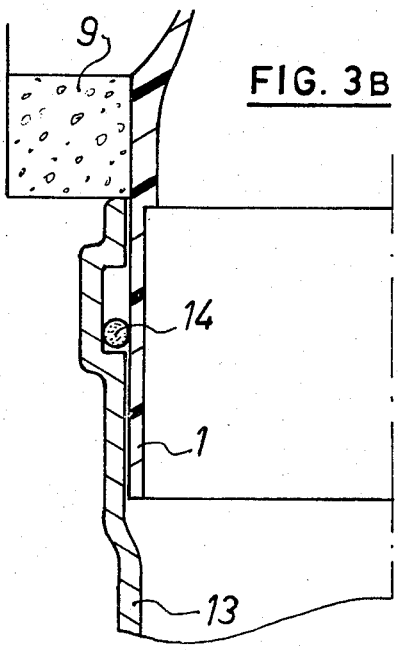
Figure 3C:
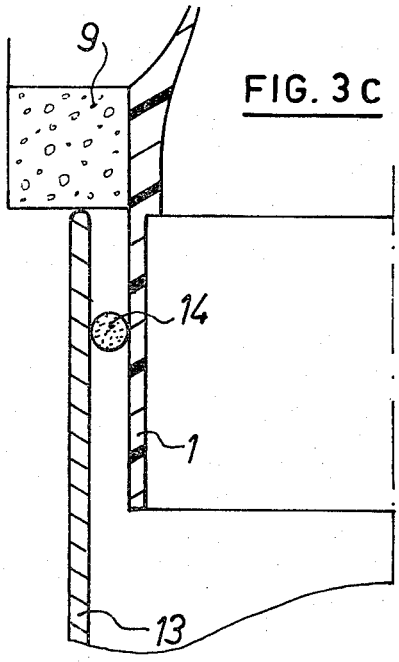

FIGS. 3, 3*a*, 3*b* and 3*c* show how a single valve type of adequate capacity can be used to connect vent pipes 13 of different diameters (e.g. 50 mm: FIG. 3; 75 mm: FIG. 3*a*; 90 mm: FIG. 3*b*; 110 mm: FIG. 3*c*).

This possibility can be obtained as follows:

(a) By locating the cylindrical body 1 outside the pipe 13 (FIGS. 3-3*a*) or inside the pipe 13 (FIGS. 3*b*-3*c*);

(b) By a varying and appropriate arrangement of the gaskets 14 (FIGS. 3-3*c*).

An important advantage is that in the case of the invention the interior of the cylindrical body 1 remains entirely free so that it can be fitted to a device such as a siphon.

A significant advantage is that with the invention, the inner portion of the cylindrical body 1 remains entirely free which permits adaptation among others to an apparatus such as a siphon.

FIG. 5 shows an installation for a dwelling in which a number of devices 21 used for the discharge of waste water (lavatory, basins, sinks, etc.) are each provided with a trap or siphon 20 to each of which is connected a pipe 18 connected to the waste pipe 23.

On the other hand a plurality of automatic valves is also provided at 19, this valve being of the type shown in FIG. 1 on a vent pipe 13.

The pipes 13 and 18 are connected to the waste pipe 23 via a venting pipe 24 provided with a fan 25 having an outlet 26 for delivery to atmosphere.

It is understood that when this fan is in operation it produces a negative pressure in all the pipes 13-18-24 and lifts the different valves 6 of the different valves 19 (FIGS. 1 and 4).

In that way, stale air can thus be discharged from the rooms via pipe 24 at 26.

The waste water discharge pipes are used at the same time as pipes for the air evacuating system from the building, all the system being put into underpressure.

What I claim is:

1. An automatic valve device connectable to a sanitation waste pipe for preventing discharge of waste gas from the pipe to the atmosphere and for admitting atmospheric air into the waste pipe in response to a pressure reduction in the waste pipe, which comprises a tubular member having an open bore extending therethrough with an upper conical section which tapers inwardly and upwardly, a cylindrical cover member overlying said upper conical section having a top wall spaced above the upper end of said conical section to form a valve seat chamber and an interior wall having an inwardly extending portion spaced radially from at least part of the upper portion of said conical member to form an annular flow passage therebetween communicating with the valve seat chamber, said inwardly extending portion defining with the upper edge of said conical section a support seat, a valve member movably mounted in said seat chamber and having a base portion designed for reception on said support seat to close said annular flow passage, said valve member being movably operative within said chamber to close said annular flow passage when the waste gas pressure in the waste pipe equals or exceeds atmospheric pressure and to open said flow passage to admit atmospheric air to the waste pipe when the waste gas pressure in the waste pipe is less than atmospheric pressure.

2. An automatic valve device according to claim 1 wherein said side wall of said cylindrical cover includes an inclined inner surface adjacent to said valve seat chamber and spaced on the periphery of said valve member, said inclined inner surface being shaped so as to preclude contact with the entire periphery of said valve member when said valve member is operative to open said flow passage.

3. An automatic valve device according to claim 1 further comprising an insulation member surrounding said cover member and at least part of said upper end of said tubular member, said insulation member having an aperture extending therethrough in communication with said flow passage.

4. An automatic valve device according to claim 3 wherein said insulation member further comprises a cover which constitutes a separate element adapted to fit on the tubular member.

5. An automatic valve device according to claim 4 in which tape is wound around said insulation member and said cover.

6. An automatic valve device according to claim 3 further comprising a netting member covering said aperture to prevent the ingress of insects or any other foreign body into said aperture.

7. An automatic valve device according to claim 1 wherein the lower end of said tubular member sealingly engages the inner surface of said sanitation waste pipe.

8. An automatic valve device according to claim 1 wherein the lower end of said tubular sealingly engages the outer surface of said sanitation waste pipe.

* * * * *